US010598178B2

(12) United States Patent
Yamada et al.

(10) Patent No.: US 10,598,178 B2
(45) Date of Patent: Mar. 24, 2020

(54) COMPRESSOR WITH MAIN BEARING, PARTITION PLATE, AND FIXED AND ORBITING SCROLLS THEREBETWEEN

(71) Applicant: Panasonic Intellectual Property Management Co., Ltd., Osaka (JP)

(72) Inventors: Sadayuki Yamada, Gunma (JP); Yusuke Imai, Shiga (JP); Atsushi Sakuda, Shiga (JP); Takashi Morimoto, Kyoto (JP); Akihiro Hayashi, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 49 days.

(21) Appl. No.: 15/504,214

(22) PCT Filed: Sep. 14, 2015

(86) PCT No.: PCT/JP2015/004665

§ 371 (c)(1),
(2) Date: Feb. 15, 2017

(87) PCT Pub. No.: WO2016/056174

PCT Pub. Date: Apr. 14, 2016

(65) Prior Publication Data

US 2017/0284393 A1 Oct. 5, 2017

(30) Foreign Application Priority Data

Oct. 9, 2014 (JP) ..... 2014-207911

(51) Int. Cl.
*F03C 2/00* (2006.01)
*F03C 4/00* (2006.01)
(Continued)

(52) U.S. Cl.
CPC ..... *F04C 18/3443* (2013.01); *F04C 18/0215* (2013.01); *F04C 27/005* (2013.01); *F04C 29/124* (2013.01)

(58) Field of Classification Search
CPC ..... F04C 18/0215; F04C 18/3443; F04C 27/005; F04C 29/124
(Continued)

(56) References Cited

U.S. PATENT DOCUMENTS 5,102,316 A 4/1992 Caillat et al.
5,106,279 A * 4/1992 Richardson, Jr. ... F04C 18/0215 418/55.5
(Continued)

FOREIGN PATENT DOCUMENTS

JP 7-027063 A 1/1995
JP 7-158565 6/1995
(Continued)

OTHER PUBLICATIONS

International Search Report of PCT application No. PCT/JP2015/004665 dated Dec. 8, 2015, 3 pages.

*Primary Examiner* — Theresa Trieu
(74) *Attorney, Agent, or Firm* — Hamre, Schumann, Mueller & Larson, P.C.

(57) ABSTRACT

A scroll compressor according to the present invention includes a partition plate that partitions a sealed container into a high-pressure space and a low-pressure space, a fixed scroll adjacent to the partition plate, a orbiting scroll, a rotation restrictor, and a main bearing. The sealed scroll compressor further includes a pillar member having a lower end portion secured in a bearing-side engagement portion provided in the main bearing, and an upper end portion inserted in a scroll-side engagement portion provided in the fixed scroll. The axial distance from the upper end portion of the pillar member to the partition plate is smaller than the length by which the pillar member and the bearing-side engagement portion are coupled together.

6 Claims, 11 Drawing Sheets

(51) Int. Cl.

| | |
|---|---|
| ***F04C 18/00*** | (2006.01) |
| ***F04C 18/344*** | (2006.01) |
| ***F04C 18/02*** | (2006.01) |
| ***F04C 27/00*** | (2006.01) |
| *F04C 29/12* | (2006.01) |

(58) Field of Classification Search
USPC ..... 418/55.1–55.6, 57
See application file for complete search history.

(56) References Cited

U.S. PATENT DOCUMENTS

| | | | | |
|---|---|---|---|---|
| 5,551,851 | A * | 9/1996 | Williams | F04C 18/0215 418/55.5 |
| 6,139,295 | A * | 10/2000 | Utter | F04C 18/0215 418/55.5 |
| 2006/0045784 | A1* | 3/2006 | Grassbaugh | F04C 18/0215 418/55.6 |
| 2015/0152868 | A1* | 6/2015 | Fu | F04C 18/0215 418/55.5 |
| 2016/0348676 | A1* | 12/2016 | Ogata | F04C 18/0215 |

FOREIGN PATENT DOCUMENTS

| | | | | |
|---|---|---|---|---|
| JP | 11-182463 | | 7/1999 | |
| JP | 3068906 | B | 7/2000 | |
| WO | WO-2015162869 | A1 * | 10/2015 | F04C 18/0215 |

* cited by examiner

COMPRESSOR WITH MAIN BEARING, PARTITION PLATE, AND FIXED AND ORBITING SCROLLS THEREBETWEEN

TECHNICAL FIELD

The present invention relates to a scroll compressor.

BACKGROUND ART

In recent years, a sealed scroll compressor including a partition plate, a compressor unit and a motor unit has been known. In the sealed scroll compressor, a partition plate partitions an inside of a pressure container into a low-pressure chamber and a high-pressure chamber. The compressor unit includes a fixed scroll and an orbiting scroll provided in the low-pressure chamber which is partitioned by the partition plate. The motor unit revolves the orbiting scroll. In this type of the sealed scroll compressor, a boss of the fixed scroll is fitted in a securing hole of the partition plate. A sealed scroll compressor that discharges refrigerant compressed in the compressor unit through a discharge port of the fixed scroll to a high-pressure chamber partitioned by a partition plate is proposed (for example, see PTL 1).

In the scroll compressor represented by the sealed scroll compressor disclosed in PTL 1, the compressor unit is surrounded by a low-pressure space, so that the orbiting scroll and the fixed scroll are forced to separate from each other.

Hence, in many sealed scroll compressors, a tip seal is used to improve sealability of a compression chamber formed between the orbiting scroll and the fixed scroll.

Back pressure however is preferably applied to the orbiting scroll or the fixed scroll to perform an efficient operation. In the sealed scroll compressor disclosed in PTL 2 for example, a back pressure is applied to the fixed scroll to push the fixed scroll against the orbiting scroll. This allows eliminating a tip seal as well as improving sealability of the compression chamber.

FIG. 11 is a longitudinal sectional view illustrating a configuration of a conventional sealed scroll compressor. Pillar member 205 secured by bolt 204 to main bearing 203 is fitted in through hole 202 provided in outer flange of fixed scroll 201, thus supporting fixed scroll 201 in a manner movable in an axial direction.

Bolt 204 securing pillar member 205 to main bearing 203 however might become loose by vibration during an operation, which allows pillar member 205 to move in the axial direction as well as a horizontal direction. This disadvantageously causes a shift of fixed scroll 201, which deteriorates reliability of the scroll compressor.

CITATION LIST

Patent Literature

PTL 1: Unexamined Japanese Patent Publication No. H11-182463

PTL 2: Japanese Patent No. 3068906

SUMMARY OF THE INVENTION

The present invention is directed to solve the aforementioned problem. An object of the present invention is to provide a scroll compressor in which a pillar member fitted in a through hole provided in the outer flange of a fixed scroll is secured to a main bearing, and an axial distance from an upper end portion of the pillar member to a partition plate is smaller than a press-fit depth of the pillar member in the main bearing.

The scroll compressor according to the present invention can restrict the movement, in the axial direction and the horizontal direction, of the pillar member fitted in the through hole provided in the outer flange of the fixed scroll. This stabilizes the behavior of the fixed scroll pushed by the back pressure against the orbiting scroll, thus improving performance and reliability.

DESCRIPTION OF EMBODIMENT

A scroll compressor according to a first exemplary embodiment includes a partition plate that partitions an inside of a sealed container into a high-pressure space and a low-pressure space, a fixed scroll adjacent to the partition plate, an orbiting scroll that meshes with the fixed scroll to form a compression chamber, a rotation restrictor that prevents rotation of the orbiting scroll, and a main bearing that supports the orbiting scroll. The fixed scroll, the orbiting scroll, the rotation restrictor, and the main bearing are disposed in the low-pressure space. The fixed scroll and the orbiting scroll are disposed between the partition plate and the main bearing. The sealed scroll compressor further includes a bearing-side engagement portion provided in the main bearing, a scroll-side engagement portion provided in the fixed scroll, and a pillar member having a lower end portion secured in the bearing-side engagement portion and an upper end portion inserted in the scroll-side engagement portion. The axial distance from the upper end portion of the pillar member to the partition plate is smaller than a length by which the pillar member and the bearing-side engagement portion are coupled together.

According to the first exemplary embodiment, the shift of the pillar member in the axially upward direction, which may happen, is restricted by the partition plate as an upper limit. This stabilizes the behavior of the fixed scroll, thus improving performance and reliability.

A second exemplary embodiment of the present invention is particularly the scroll compressor according to the first exemplary embodiment in which the pillar member is securely press fit in the bearing-side engagement portion in a manner of interference fit whereas inserted in the scroll-side engagement portion in a manner of clearance fit.

A third exemplary embodiment of the present invention is particularly the scroll compressor according to the first or the second exemplary embodiment that further includes a welded pin press fit in the main bearing from a radially outer side, and the bearing-side engagement portion penetrates the main bearing in an axial direction and projects below the main bearing. The welded pin penetrates a penetration portion below an engaging region of the bearing-side engagement portion.

In the third exemplary embodiment, the main bearing is welded to the sealed container with a higher weld-strength and the shift of the pillar member in the axially downward direction, which may happen, is restricted by the welded pin as the lower limit. This stabilizes the behavior of the fixed scroll, thus improving performance and reliability.

An exemplary embodiment of the present invention will now be described below with reference to the drawings. Note that the present invention is not limited to the exemplary embodiment described below.

Figure 1:
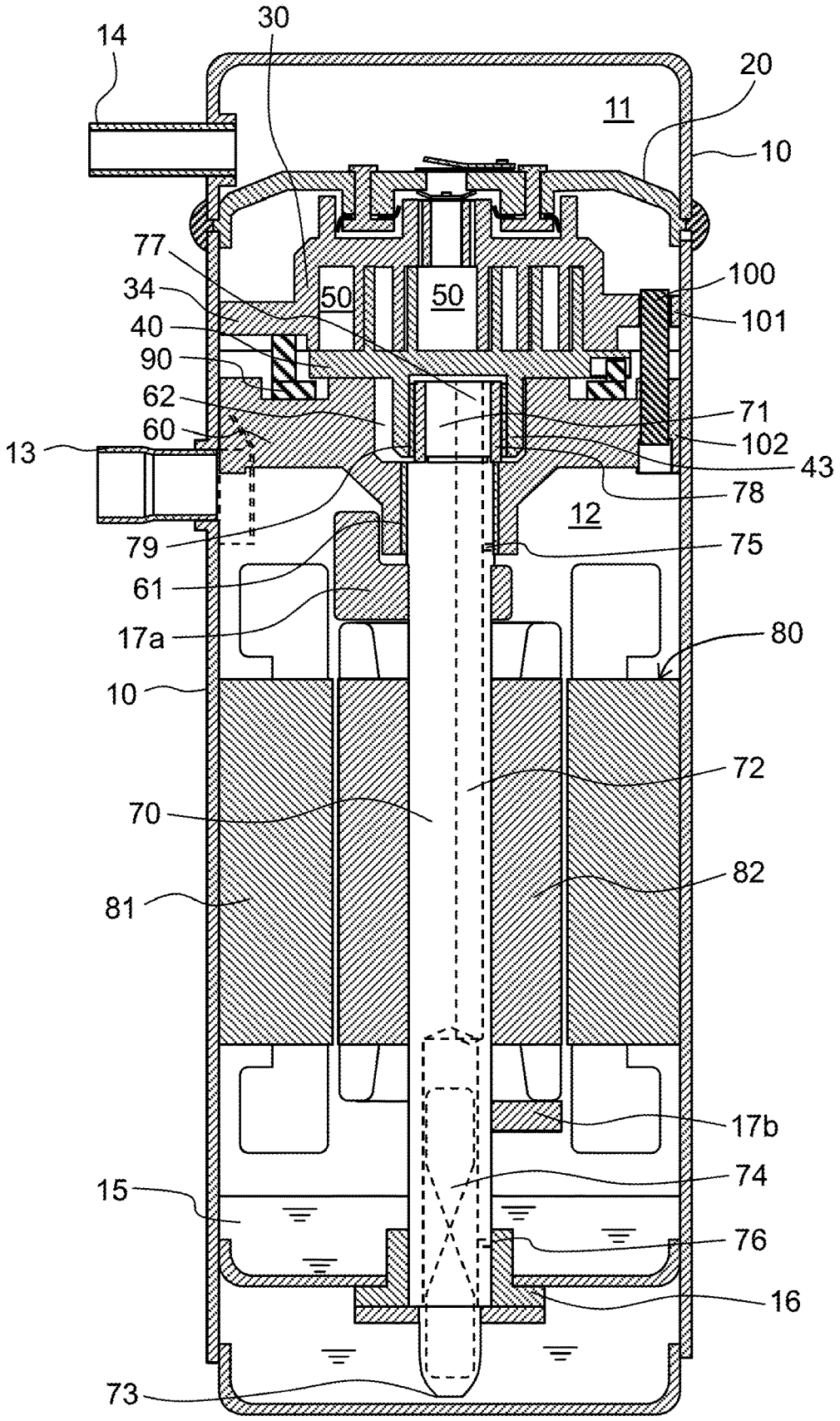
FIG. 1 is a longitudinal sectional view illustrating a configuration of a sealed scroll compressor according to an exemplary embodiment of the present invention.

FIG. 1 is a longitudinal sectional view illustrating a configuration of a sealed scroll compressor according to the exemplary embodiment. As illustrated in FIG. 1, the sealed scroll compressor includes sealed container 10 having a form of a cylinder extending in the vertical direction. Partition plate 20 that partitions an inside of sealed container 10 into upper and lower parts is provided in an upper portion of sealed container 10. Partition plate 20 partitions the inside of sealed container 10 into high-pressure space 11 and low-pressure space 12.

Refrigerant suction tube 13 for introducing refrigerant into low-pressure space 12 and refrigerant discharge tube 14 for discharging the compressed refrigerant from high-pressure space 11 are provided in sealed container 10. Oil reservoir 15 where lubricating oil is accumulated is provided in a bottom portion of low-pressure space 12.

Fixed scroll 30 and orbiting scroll 40 serving as a compressor mechanism are provided in low-pressure space 12. Fixed scroll 30 is adjacent to partition plate 20. Orbiting scroll 40 meshes with fixed scroll 30 to form compression chamber 50.

Main bearing 60 that supports orbiting scroll 40 is provided below fixed scroll 30 and orbiting scroll 40. Bearing 61 and boss house 62 are provided approximately in a center of main bearing 60. Bearing 61 rotatably supports rotation shaft 70. Bearing 61 and sub-bearing 16 support rotation shaft 70. Eccentric shaft 71 positioned to be eccentric from an axis of rotation shaft 70 is provided on the top end of rotation shaft 70.

Oil passage 72 through which the lubricating oil passes is provided inside rotation shaft 70. Suction port 73 for the lubricating oil is provided at a lower end portion of rotation shaft 70. Paddle 74 is provided above suction port 73. Oil passage 72 communicates with suction port 73 and paddle 74 and extends in an axial direction of rotation shaft 70. Oil passage 72 includes oil supply port 75 for supplying the lubricating oil to bearing 61, oil supply port 76 for supplying lubricating oil to sub-bearing 16, and oil supply port 77 for supplying lubricating oil to boss house 62.

Eccentric shaft 71 is inserted via swing bush 78 and revolve bearing 79 in boss 43 in a manner allowed to revolve.

Motor unit 80 is configured of stator 81 fixed to sealed container 10 and rotor 82 disposed in an inner side of stator 81.

Rotor 82 is fixed to rotation shaft 70. Balance weights 17*a*, 17*b* are attached to rotation shaft 70 respectively above and below rotor 82. Balance weight 17*a* and balance weight 17*b* are separately positioned by 180 degrees about the axis of rotation shaft 70. Centrifugal forces acting on balance weights 17*a*, 17*b* balance with a centrifugal force generated by the revolution of orbiting scroll 40. Balance weights 17*a*, 17*b* may be fixed to rotor 82.

Rotation restrictor 90 (oil dam ring) prevents orbiting scroll 40 from rotating. Orbiting scroll 40 is supported by fixed scroll 30 via rotation restrictor 90. In this manner, orbiting scroll 40 revolves with respect to fixed scroll 30 without rotating.

Pillar member 100 hinders rotation and radial movement of fixed scroll 30 but allows an axial movement of fixed scroll 30. Fixed scroll 30 is supported by main bearing 60 via pillar member 100 in a manner allowed to move in an axial direction between partition plate 20 and main bearing 60.

Fixed scroll 30, orbiting scroll 40, motor unit 80, rotation restrictor 90, and main bearing 60 are disposed in low-pressure space 12, and fixed scroll 30 and orbiting scroll 40 are disposed between partition plate 20 and main bearing 60.

Rotor 82 rotates together with rotation shaft 70 by driving motor unit 80. Eccentric shaft 71 causes revolving scroll 40 to revolve without rotating to compress the refrigerant in compression chamber 50.

The refrigerant is introduced from refrigerant suction tube 13 into low-pressure space 12. The refrigerant in a circumferentially outer region of orbiting scroll 40 in low-pressure space 12 is introduced into compression chamber 50. The refrigerant is compressed in compression chamber 50 and then passes through high-pressure space 11 to be discharged from refrigerant discharge tube 14.

Rotating rotation shaft 70 causes the lubricating oil accumulated in oil reservoir 15 to enter oil passage 72 from suction port 73 to be pumped up along paddle 74 in oil passage 72. The pumped-up lubricating oil is supplied to bearing 61, sub-bearing 16, and boss house 62 respectively from oil supply ports 75, 76, and 77. The lubricating oil pumped up to boss house 62 is guided along faces of main bearing 60 and orbiting scroll 40 sliding against each other and discharged through return passage 63 (see FIG. 6) provided in the main bearing to return to oil reservoir 15.

Figure 2A:
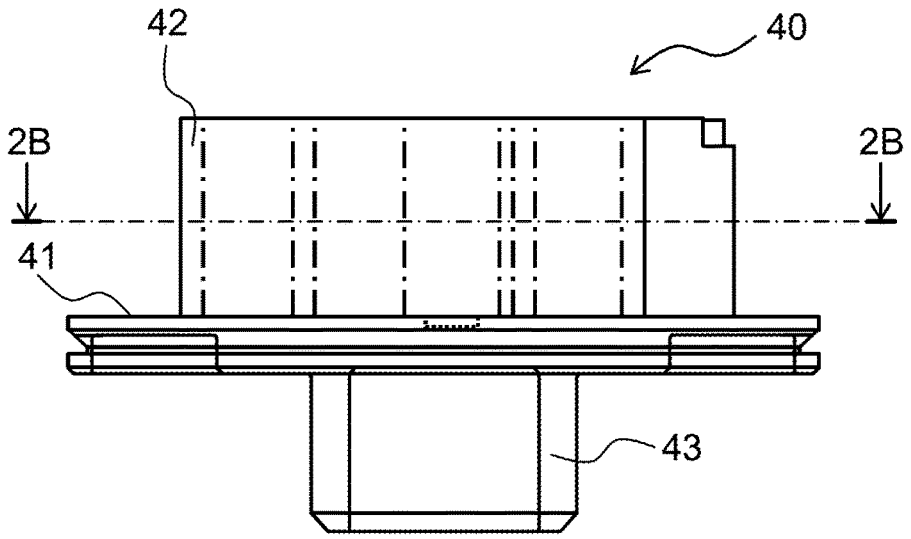
FIG. 2A is a side view of an orbiting scroll of the sealed scroll compressor according to the exemplary embodiment.
Figure 2B:
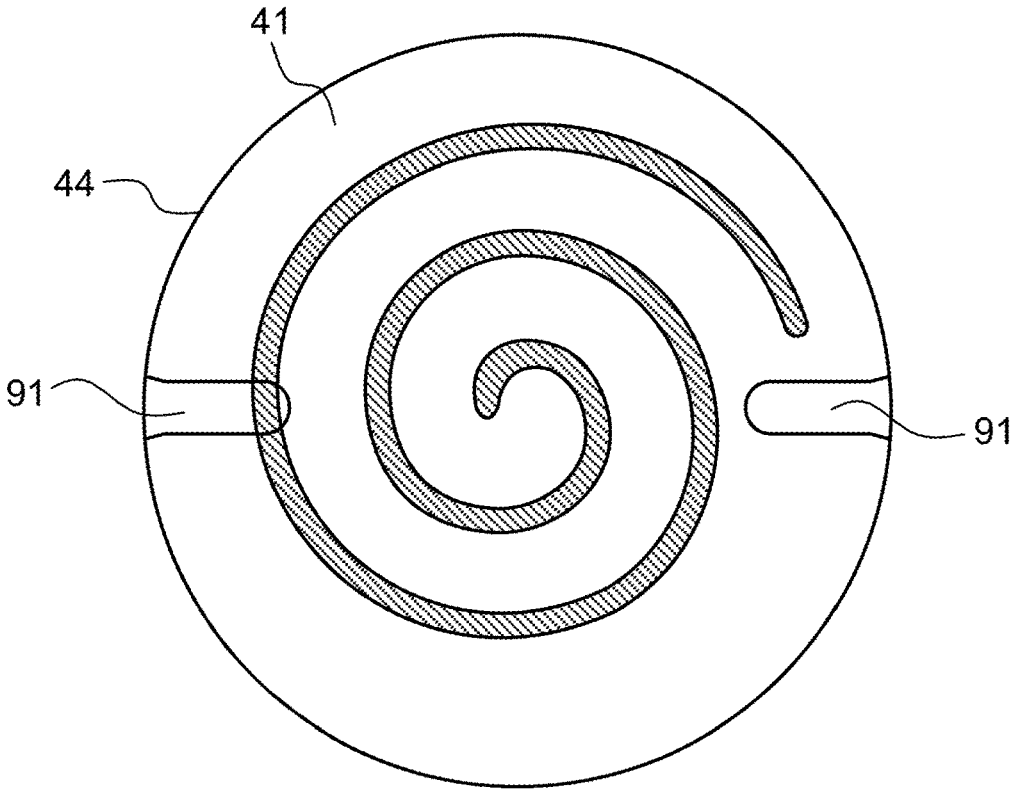
FIG. 2B is a sectional view taken along line 2B-2B in FIG. 2A.

FIG. 2A is a side view of the orbiting scroll of the sealed scroll compressor according to the exemplary embodiment. FIG. 2B is a sectional view taken along line 2B-2B in FIG. 2A.

Orbiting scroll 40 includes orbiting scroll plate 41 having a disk shape, orbiting scroll wrap 42 having a scroll shape and provided upright on orbiting scroll plate 41, and cylindrical boss 43 provided approximately in a center of a bottom face of orbiting scroll plate 41.

As illustrated in FIG. 2B, a pair of first key grooves 91 is formed in orbiting scroll plate 41.

Figure 3:
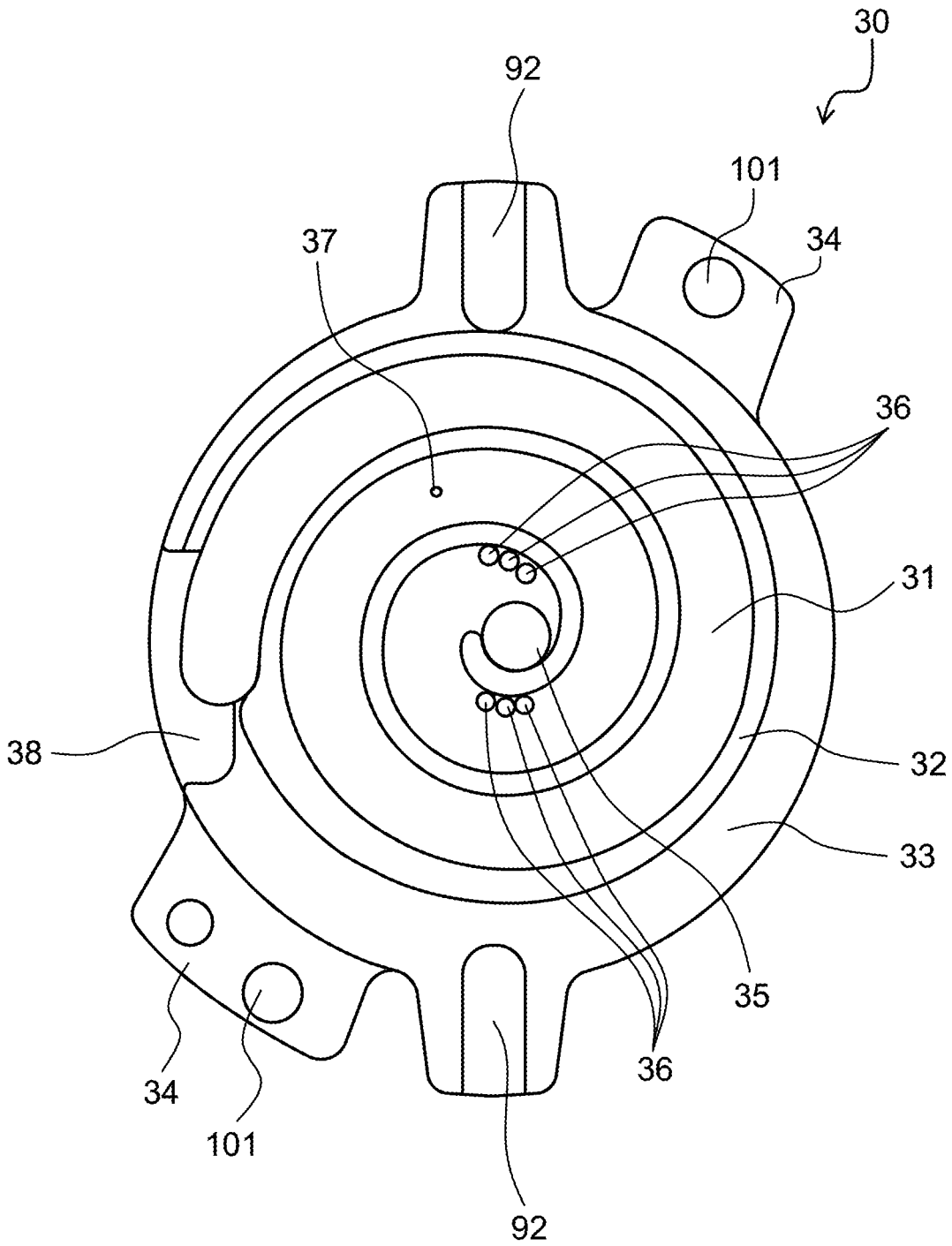
FIG. 3 is a bottom view illustrating a fixed scroll of the sealed scroll compressor according to the exemplary embodiment of the present invention.
Figure 4:
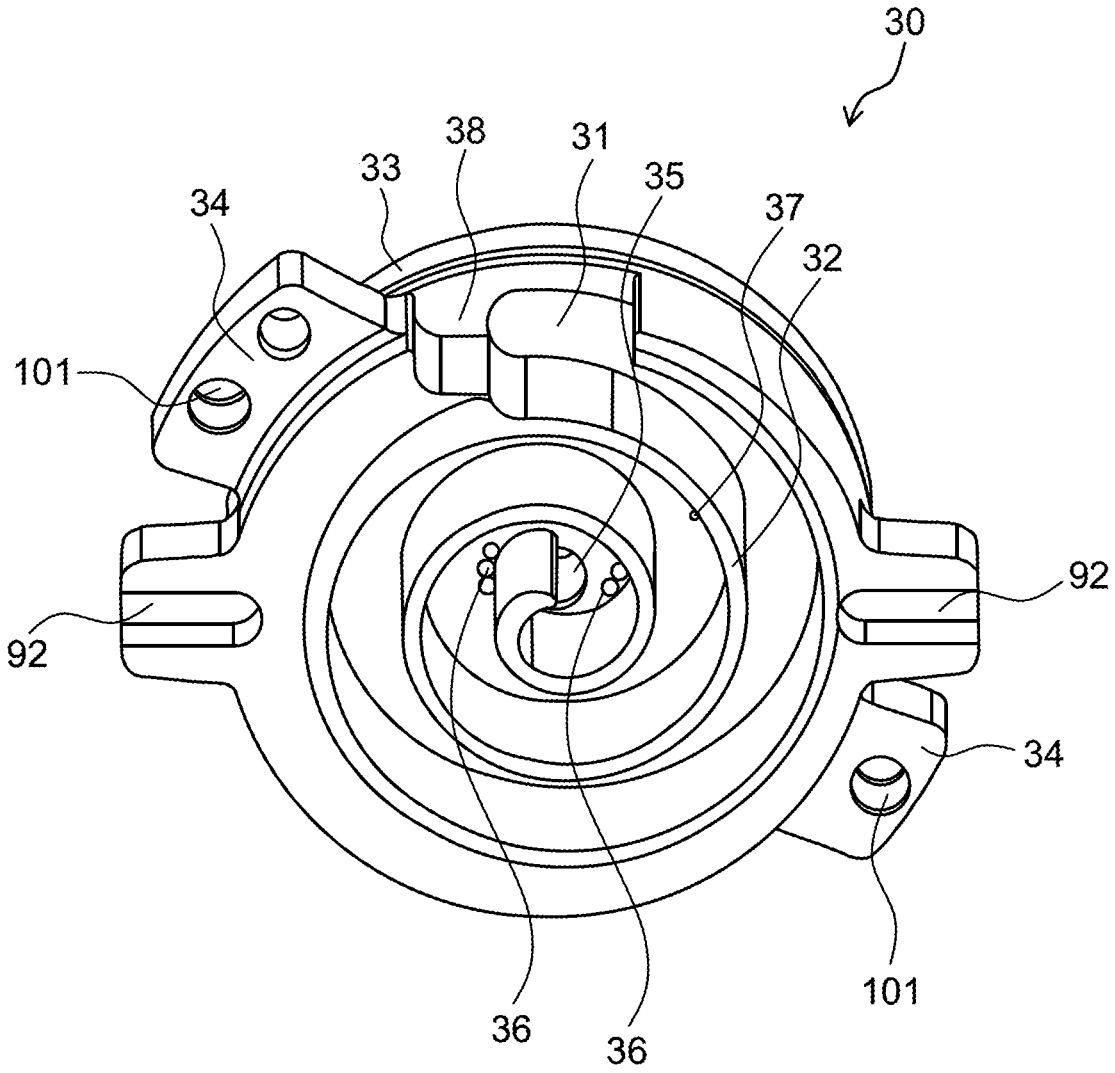
FIG. 4 is a perspective view of the fixed scroll viewed from a bottom side.
Figure 5:
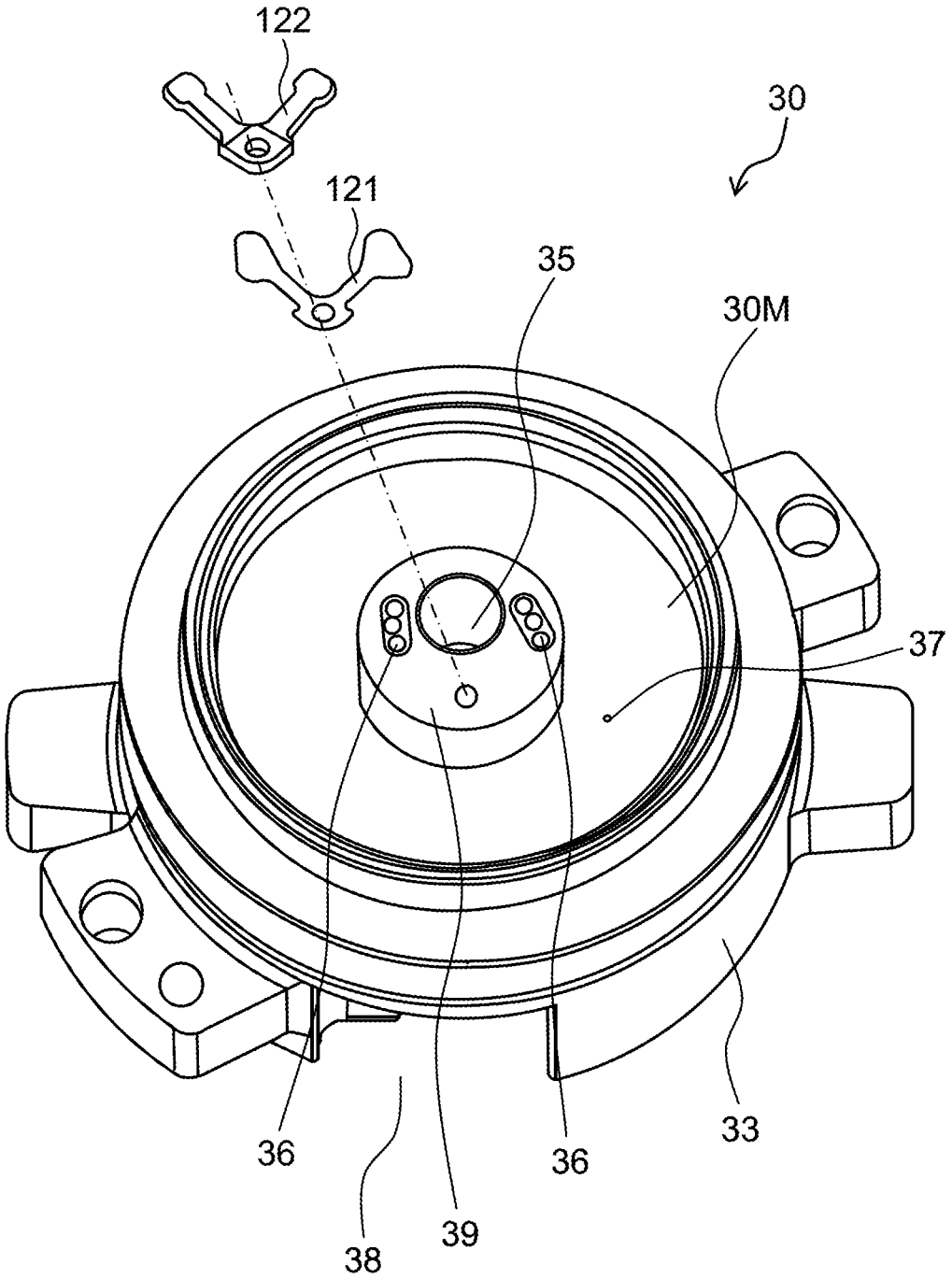
FIG. 5 is a perspective view of the fixed scroll viewed from a top side.

FIG. 3 is a bottom view illustrating a fixed scroll of the sealed scroll compressor according to the exemplary embodiment. FIG. 4 is a perspective view of the fixed scroll viewed from a bottom side. FIG. 5 is a perspective view of the fixed scroll viewed from a top side.

Fixed scroll 30 includes fixed scroll plate 31 having a disk shape, fixed scroll wrap 32 having a scroll shape and provided upright on a bottom face of fixed scroll plate 31, circumferential wall 33 provided upright to surround a periphery of fixed scroll wrap 32, and flange 34.

First discharge port 35 is formed approximately in a center of fixed scroll plate 31. Fixed scroll plate 31 is provided with bypass port 36 and mid-pressure port 37. Bypass port 36 is located near first discharge port 35 in a high-pressure region where compression is almost completed. Mid-pressure port 37 is located in an intermediate pressure region where compression is still taking place. Suction inlet 38 for taking the refrigerant into compression chamber 50 is provided in circumferential wall 33 of fixed scroll 30. Second key groove 92 is provided in a portion of circumferential wall 33. Scroll-side engagement portion 101 in which a top end of pillar member 100 is inserted is provided in flange 34.

As illustrated in FIG. 5, boss 39 is provided in a center of an upper face of fixed scroll 30 (a face opposing partition plate 20). First discharge port 35 and bypass port 36 are provided in boss 39.

Figure 8:
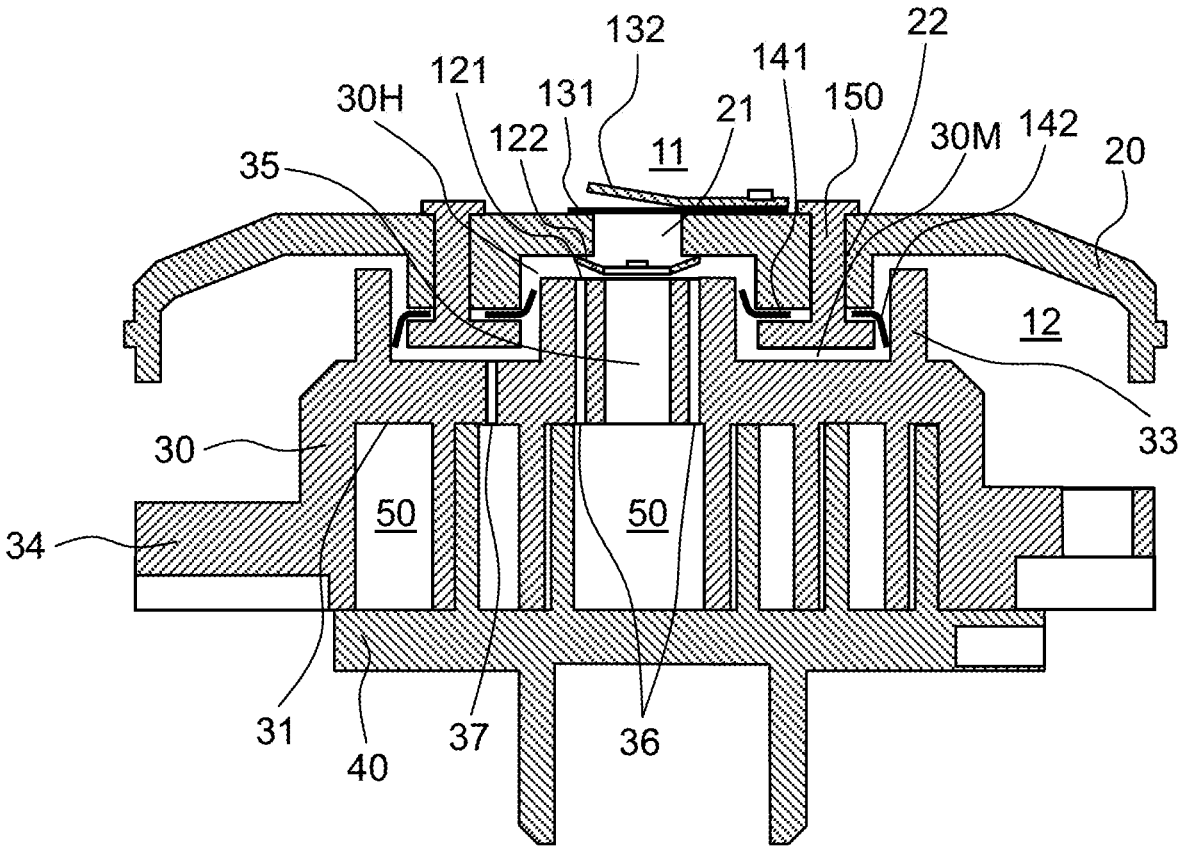
FIG. 8 is a sectional view of an essential portion illustrating a partition plate and the fixed scroll of the sealed scroll compressor according to the exemplary embodiment.

A ring shaped recess is provided between circumferential wall 33 and boss 39 in the upper face of fixed scroll 30 to form intermediate pressure space 30M (see FIG. 8). Mid-pressure port 37 is provided in the intermediate pressure space 30M. Mid-pressure port 37 has a diameter smaller than an inner wall thickness and an outer wall thickness of orbiting scroll wrap 42. The diameter of mid-pressure port 37 smaller than the inner wall thickness and the outer wall thickness of orbiting scroll wrap 42 prevents communication between compression chamber 50 in an inner wall side of orbiting scroll wrap 42 and compression chamber 50 in an outer wall side of orbiting scroll wrap 42.

Boss 39 is provided with bypass check valve 121 that can shut bypass port 36 and bypass check valve stopper 122. Bypass check valve 121 can be made compact in height by using a reed valve. A V-reed valve may be used as bypass check valve 121. This valve can shut bypass port 36 which communicates with compression chamber 50 in the outer wall side of orbiting scroll wrap 42, and bypass port 36 which communicates with compression chamber 50 in the inner wall side of orbiting scroll wrap 42.

Figure 6:
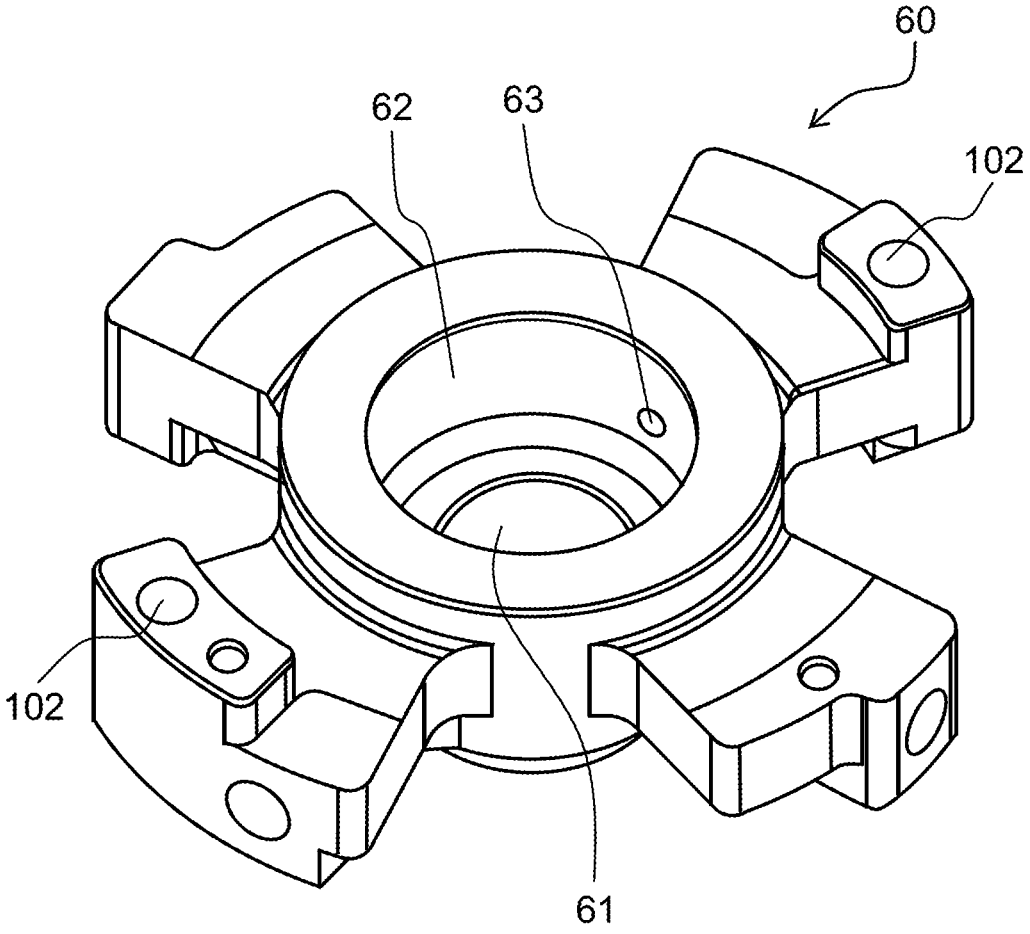
FIG. 6 is a perspective view of a main bearing of the sealed scroll compressor according to the exemplary embodiment.

FIG. 6 is a perspective view of a main bearing of the sealed scroll compressor according to the exemplary embodiment. Bearing 61 and boss house 62 are provided approximately in a center of main bearing 60. Bearing-side engagement portion 102 in which the lower end portion of pillar member 100 is inserted is provided in an outer circumference of main bearing 60. Return passage 63 is provided in main bearing 60 to communicate with boss house 62.

Figure 7:
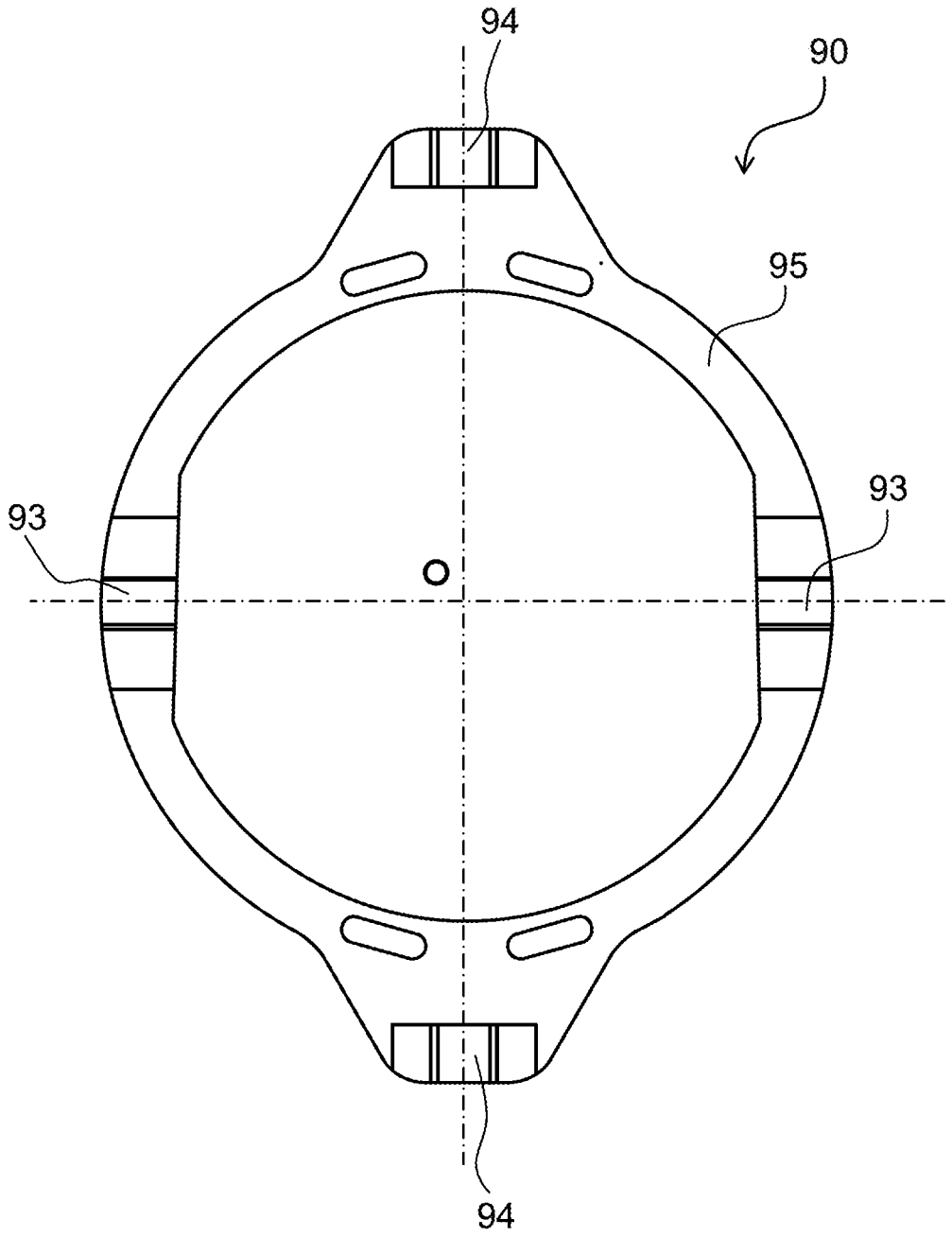
FIG. 7 is a top view illustrating a rotation restrictor of the sealed scroll compressor according to the exemplary embodiment.

FIG. 7 is a top view illustrating a rotation restrictor of the sealed scroll compressor according to the exemplary embodiment.

Rotation restrictor (oil dam ring) 90 is provided with first key 93 and second key 94. First key 93 engages with first key groove 91 of orbiting scroll 40, and second key 94 engages with second key groove 92 of fixed scroll 30. Thus, orbiting scroll 40 can revolve with respect to fixed scroll 30 without rotating. As illustrated in FIG. 1, fixed scroll 30, orbiting scroll 40, and oil dam ring 90 are arranged in this order, with fixed scroll 30 in an uppermost, in the axial direction of rotation shaft 70. Since fixed scroll 30, orbiting scroll 40, and oil dam ring 90 are arranged in this order, first key 93 and second key 94 of oil dam ring 90 are provided on the same face of ring 95. Thus, first key 93 and second key 94 can be processed from the same direction when processing oil dam ring 90, and thus the number of times of detaching oil dam ring 90 from a machining device can be reduced. This improves machining accuracy with reduced machining cost.

FIG. 8 is a sectional view of an essential portion illustrating a partition plate and the fixed scroll of the sealed scroll compressor according to the exemplary embodiment. Second discharge port 21 is provided in a center of partition plate 20. Second discharge port 21 is provided with discharge check valve 131 and discharge check valve stopper 132. Discharge space 30H communicating with first discharge port 35 is provided between partition plate 20 and fixed scroll 30. Discharge space 30H communicates via second discharge port 21 with high-pressure space 11. Discharge check valve 131 shuts second discharge port 21.

In the exemplary embodiment, high-pressure produced in discharge space 30H between partition plate 20 and fixed scroll 30 pushes fixed scroll 30 against orbiting scroll 40. In this manner, the gap between fixed scroll 30 and orbiting scroll 40 is eliminated, and thus a highly efficient operation can be performed.

In the exemplary embodiment, bypass port 36, besides first discharge port 35, provides communication between compression chamber 50 and discharge space 30H, and bypass check valve 121 is provided at bypass port 36. In this manner, a reverse flow from discharge space 30H can be prevented and at the same time, a flow can be introduced into discharge space 30H when the pressure reaches a predetermined value. This can achieve a highly efficient operation in a wide operating range.

Discharge check valve 131 has a larger thickness than bypass check valve 121. First discharge port 35 has a smaller volume than second discharge port 21. This reduces the pressure loss in refrigerant discharged from compression chamber 50. The loss in discharge pressure can be reduced by providing a taper at an inflow side of second discharge port 21.

The sealed scroll compressor according to the exemplary embodiment includes ring-shaped first seal 141 provided between partition plate 20 and fixed scroll 30 in an outer circumference of discharge space 30H. The sealed scroll compressor further includes ring-shaped second seal 142 provided between partition plate 20 and fixed scroll 30 in an outer circumference of first seal 141.

As a material of first seal 141 and second seal 142, for example, polytetrafluoroethylene, which is a fluorine resin, is suitable regarding sealing and assembly. Mixing a fibrous material in a fluorine resin improves reliability of sealing of first seal 141 and second seal 142.

First seal 141 and second seal 142 are clamped between plugging member 150 and partition plate 20. By using plugging member 150 made of aluminum, plugging member 150 is swaged against partition plate 20.

Intermediate pressure space 30M is formed between first seal 141 and second seal 142. The pressure in intermediate pressure space 30M communicating through mid-pressure port 37 with compression chamber 50 in the intermediate pressure region where compression is still taking place is lower than the pressure in discharge space 30H and higher than the pressure in low-pressure space 12.

In the exemplary embodiment, intermediate pressure space 30M is provided, besides high-pressure discharge space 30H, between partition plate 20 and fixed scroll 30, so that a force pushing fixed scroll 30 against orbiting scroll 40 is easy to adjust.

In the exemplary embodiment, first seal 141 and second seal 142 form discharge space 30H and intermediate pressure space 30M. Thus, leakage of refrigerant from the high pressure discharge space 30H to intermediate pressure space 30M and from intermediate pressure space 30M to low-pressure space 12 is reduced.

In the exemplary embodiment, first seal 141 and second seal 142 are clamped between plugging member 150 and partition plate 20. Thus, partition plate 20, first seal 141, second seal 142, and plugging member 150 previously assembled together are disposed in sealed container 10. This reduces the number of parts and makes assembling of the scroll compressor easy.

Figure 9:
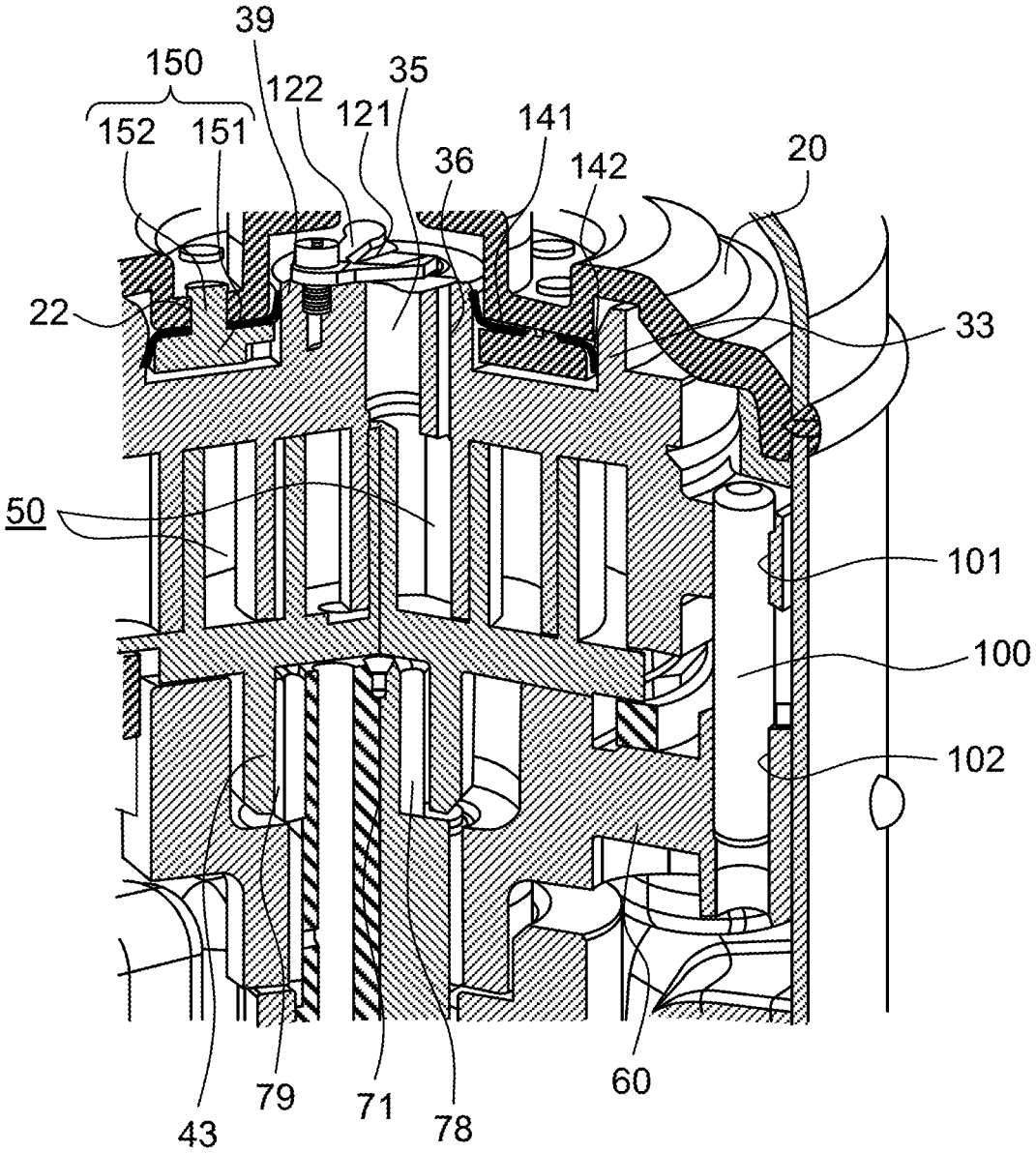
FIG. 9 is a view for describing an essential portion of the sealed scroll compressor according to the exemplary embodiment.

FIG. 9 is a view for describing an essential portion of the sealed scroll compressor according to the exemplary embodiment. As illustrated in FIG. 9, plugging member 150 in FIG. 8 includes ring member 151 and a plurality of projections 152 provided on a face of ring member 151.

An outer circumference of first seal 141 is clamped between an inner circumferential upper face of ring member 151 and partition plate 20. An inner circumference of second seal 142 is clamped between an outer circumferential upper face of ring member 151 and partition plate 20.

Ring member 151 is attached to partition plate 20 with first seal 141 and second seal 142 clamped between ring member 151 and partition plate 20.

Plugging member 150 is attached to partition plate 20 by inserting projections 152 in holes 22 provided in partition plate 20 and then, with ring member 151 pushed against a bottom face of partition plate 20, swaging the end of each of projections 152.

With plugging member 150 attached to partition plate 20, the inner circumference of first seal 141 projects into the inner circumference of ring member 151, and the outer circumference of second seal 142 projects into the outer circumference of ring member 151.

By assembling partition plate 20, to which plugging member 150 is attached, in sealed container 10, the inner circumference of first seal 141 is pushed against the outer circumference of boss 39 of fixed scroll 30, and the outer circumference of second seal 142 is pushed against an inner circumference of circumferential wall 33 of fixed scroll 30.

Figure 10A:
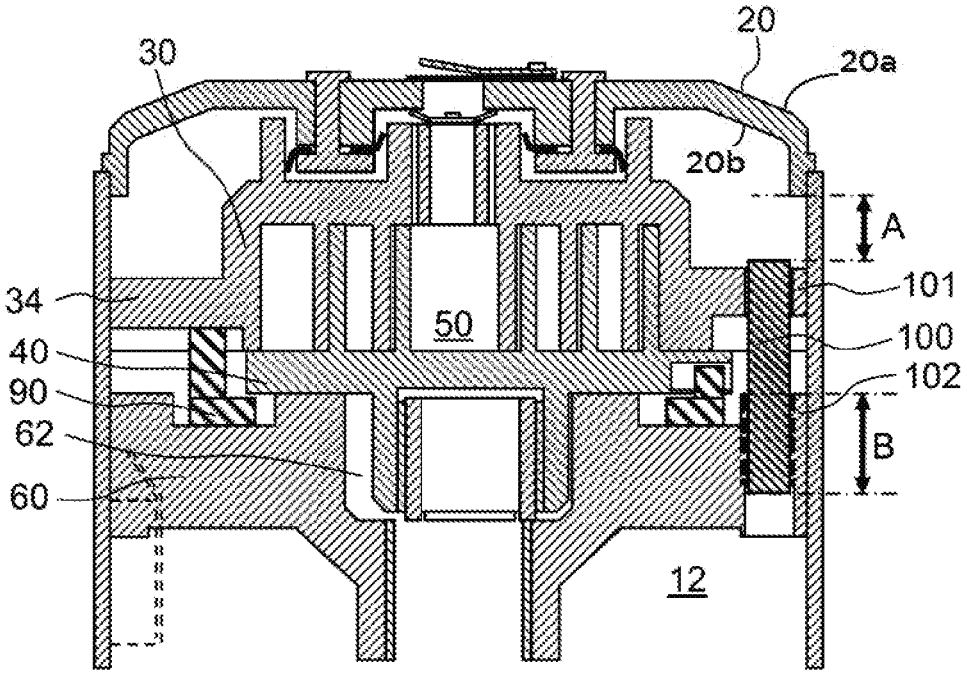
FIG. 10A is a longitudinal sectional view illustrating the relationship between the pillar member and the partition plate of the sealed scroll compressor according to the exemplary embodiment.

FIG. 10A is longitudinal sectional view illustrating the relationship between the pillar member and the partition plate of the sealed scroll compressor according to the exemplary embodiment. Bearing-side engagement portion 102 is provided in the outer circumference of main bearing 60, and scroll-side engagement portion 101 is provided in fixed scroll 30. The lower end portion of pillar member 100 is press fit in bearing-side engagement portion 102, and the upper end portion of pillar member 100 is fit in scroll-side engagement portion 101 in a manner of clearance fit to slide.

In the exemplary embodiment, axial distance A from the upper end portion of pillar member 100 to partition plate 20 is smaller than engaging region B by which pillar member 100 and bearing-side engagement portion 102 are coupled together.

With such a configuration, the movement of pillar member 100 can be restricted by bearing-side engagement portion 102, which stabilizes the behavior of fixed scroll 30 pushed by the back pressure against orbiting scroll 40, thus improving performance. The shift of pillar member 100 in the axially upward direction, which may happen, is restricted by partition plate 20, preventing pillar member 100 to come out of bearing-side engagement portion 102, thus improving reliability.

The partition plate 20 includes an upper surface 20*a* and a lower surface 20*b* that faces the fixed scroll 30, with both the upper surface 20*a* and the lower surface 20*b* being bent toward the fixed scroll 30 side at a periphery of the upper surface 20*a* and the lower surface 20*b*. The tip of the periphery of the upper surface 20*a* and the lower surface 20*b* of the partition plate 20 is disposed above the upper end portion of the pillar member 100.

The bottom of bearing-side engagement portion 102 may be plugged or opened in the axial direction. The plugged bottom disallows pillar member 100, which may shift axially downward, to come out, thus improving reliability.

Figure 10B:
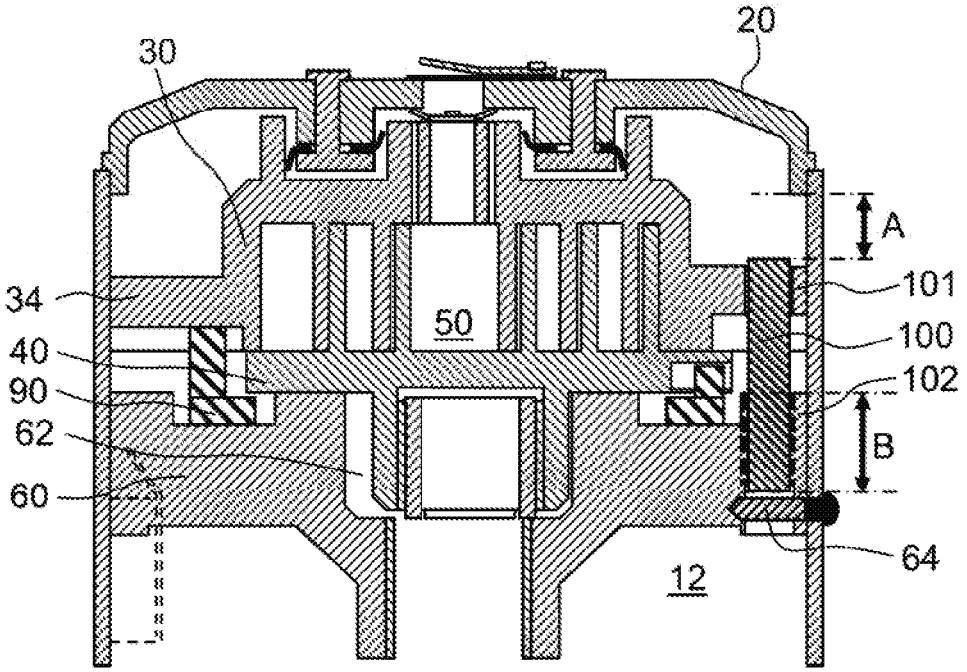
FIG. 10B is a longitudinal sectional view illustrating a welded pin provided in the main bearing.
Figure 11:
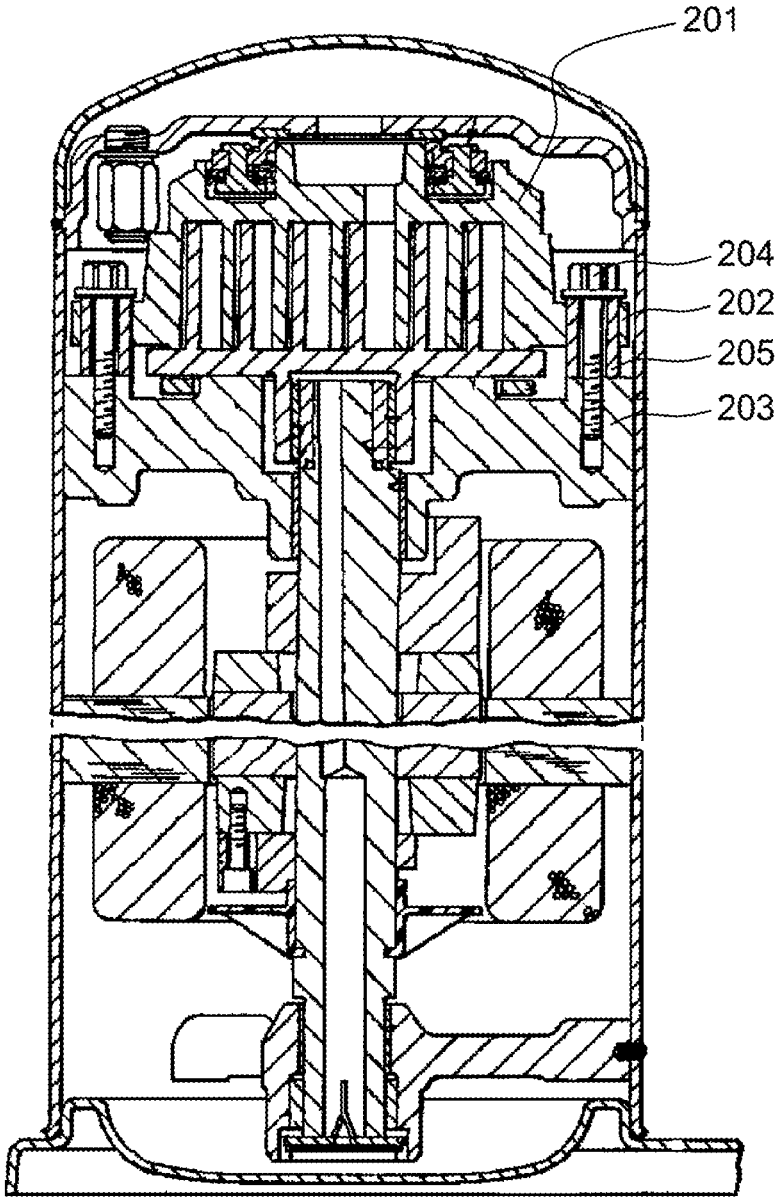
FIG. 11 Prior Art
FIG. 11 is a longitudinal sectional view illustrating a configuration of a conventional sealed scroll compressor.

FIG. 10B is a longitudinal sectional view of the sealed scroll compressor according to an embodiment including welded pin 64 provided in the main bearing. Welded pin 64 is press fit in main bearing 60 from a radially outer side and then welded to sealed container 10.

The exemplary embodiment includes bearing-side engagement portion 102 provided in main bearing 60 to penetrate in an axially downward direction and a welded pin penetrating into the penetration portion below engaging region B of bearing-side engagement portion 102.

Such a configuration strengthen the weld of main bearing 60 to sealed container 10 and improves reliability, and also improves accuracy of machining bearing-side engagement portion 102, thus reducing left over chips. This improves productivity. The shift of pillar member 100 in the axially downward direction, which may happen, is restricted by welded pin 64 to prevent pillar member 100 from coming out downward, thus improving reliability.

A member for restricting the axial movement of pillar member 100 is not limited to partition plate 20 used in the exemplary embodiment. Any member opposing pillar member 100 in the axial direction can be used as long as the distance from the upper end portion of pillar member 100 to the member located above pillar member 100 is smaller than a length by which pillar member 100 and bearing-side engagement portion 102 are coupled together.

INDUSTRIAL APPLICABILITY

The present invention is useful for a compressor for a refrigeration cycle device applicable to an electric product, such as a water heater, a hot water heater, and an air conditioner.

REFERENCE MARKS IN THE DRAWINGS

10: sealed container
11: high-pressure space
12: low-pressure space
20: partition plate
21: second discharge port
30: fixed scroll
30H: discharge space
30M: intermediate pressure space
31: fixed scroll plate
32: fixed scroll wrap
33: circumferential wall
34: flange
35: first discharge port
36: bypass port
37: mid-pressure port

38: suction inlet
39: boss
40: orbiting scroll
41: orbiting scroll plate
42: orbiting scroll wrap
43: boss
50: compression chamber
60: main bearing
61: bearing
62: boss house
63: return passage
64: welded pin
70: rotation shaft
71: eccentric shaft
72: oil passage
73: suction port
74: paddle
75, 76, 77: oil supply port
80: motor unit
90: rotation restrictor (oil dam ring)
100: pillar member
101: scroll-side engagement portion
102: bearing-side engagement portion
121: bypass check valve
131: discharge check valve
141: first seal
142: second seal
150: plugging member

The invention claimed is:

1. A scroll compressor comprising:

a partition plate that partitions an inside of a sealed container into a high-pressure space and a low-pressure space;

a fixed scroll adjacent to the partition plate;

an orbiting scroll that meshes with the fixed scroll to form a compression chamber;

a rotation restrictor that prevents rotation of the orbiting scroll;

a main bearing that supports the orbiting scroll, the fixed scroll, the orbiting scroll, the rotation restrictor, and the main bearing being disposed in the low-pressure space, and the fixed scroll and the orbiting scroll being disposed between the partition plate and the main bearing;

a bearing-side engagement portion provided in the main bearing;

a scroll-side engagement portion provided in the fixed scroll; and a pillar member having a lower end portion secured in the bearing-side engagement portion and an upper end portion inserted in the scroll-side engagement portion, wherein the partition plate comprises an upper surface and a lower surface that faces the fixed scroll, with both the upper surface and the lower surface being bent toward the fixed scroll side at a periphery of the upper surface and the lower surface, an axial distance from the upper end portion of the pillar member to a tip of the periphery of the upper surface and the lower surface of the partition plate is smaller than a length by which the pillar member and the bearing-side engagement portion are coupled together, the tip of the periphery of the upper surface and the lower surface of the partition plate is disposed above the upper end portion of the pillar member, wherein a size of the lower end portion of the pillar member and a size of the bearing-side engagement portion provide press fitting of the lower end portion of the pillar member in the bearing-side engagement portion in a manner of interference fit, and a size of the upper end portion of the pillar member and a size of the scroll-side engagement portion provide engagement of the upper end portion of the pillar member in the scroll-side engagement portion in a manner of clearance fit.

2. The scroll compressor according to claim 1, further comprising a welded pin press fit in the main bearing from a radially outer side, wherein the bearing-side engagement portion penetrates the main bearing in an axial direction and projects below the main bearing, and the welded pin penetrates a penetration portion below an engaging region of the bearing-side engagement portion.

3. The scroll compressor according to claim 1, wherein a lower end of the partition plate is disposed above the upper end portion of the pillar member.

4. The scroll compressor according to claim 1, wherein the rotation restrictor includes a first key and a second key, the orbiting scroll includes a first key groove, the fixed scroll includes a second key groove, and the first key engages with the first key groove, and the second key engages with the second key groove.

5. The scroll compressor according to claim 1, wherein the fixed scroll is provided with a first discharge port and a second discharge port that is different from the first discharge port, a first discharge space is provided between the partition plate and the fixed scroll, and the first discharge space communicates with the compression chamber via the first discharge port and the second discharge port.

6. The scroll compressor according to claim 5, wherein the fixed scroll is provided with a third discharge port that is different from the first discharge port and the second discharge port, a second discharge space is provided between the partition plate and the fixed scroll, a pressure in the second discharge space is lower than a pressure in the first discharge space, and the second discharge space communicates with the compression chamber via the third discharge port.

* * * * *